United States Patent [19]

Perlman

[11] Patent Number: 5,060,823

[45] Date of Patent: Oct. 29, 1991

[54] STERILE TRANSFER SYSTEM

[75] Inventor: Daniel Perlman, Arlington, Mass.

[73] Assignee: Brandeis University, Waltham, Mass.

[21] Appl. No.: 244,942

[22] Filed: Sep. 15, 1988

[51] Int. Cl.[5] ..... B67B 7/00

[52] U.S. Cl. ..... 222/1; 222/158; 222/402.1; 222/402.12; 222/562; 250/432 R; 435/30

[58] Field of Search ..... 222/158, 386, 402.1, 222/402.12, 1, 562; 250/432 R; 604/171; 435/30

[56] References Cited

U.S. PATENT DOCUMENTS

| | | | |
|---|---|---|---|
| 2,777,372 | 12/1956 | Jordan | 222/182 |
| 2,837,245 | 6/1958 | Grebowiec | 222/402.1 X |
| 2,908,446 | 10/1959 | Strouse | 222/402.1 X |
| 2,947,451 | 8/1960 | Suellentrop | 222/182 |
| 2,961,128 | 11/1960 | Cochran | 222/182 |
| 3,022,922 | 2/1962 | Patton et al. | 222/182 |
| 3,035,691 | 5/1962 | Rasmussen et al. | 604/171 X |
| 3,039,938 | 6/1962 | Charm | 435/30 X |
| 3,112,031 | 11/1963 | Stewart | 604/171 X |
| 3,225,958 | 12/1965 | Frankenberg | 220/60 |
| 3,305,144 | 2/1967 | Beres et al. | 222/402.13 |
| 3,368,591 | 2/1968 | Zerbetto | 222/158 X |
| 3,428,224 | 2/1969 | Eberhardt et al. | 222/402.13 |
| 3,464,593 | 9/1969 | Abplanalp | 222/182 |
| 3,565,295 | 2/1971 | Doyle | 222/182 |
| 3,690,519 | 9/1972 | Wassilieff | 222/402.13 |
| 3,739,906 | 3/1988 | Lo Turco | 222/494 X |
| 3,817,703 | 6/1979 | Atwood | 250/432 X |
| 4,096,974 | 5/1978 | Haber et al. | 222/402.13 |
| 4,132,775 | 1/1979 | Volenec et al. | 514/889 X |
| 4,278,188 | 7/1981 | Stephenson et al. | 222/182 |
| 4,291,024 | 9/1981 | Turcotte | 514/48 |
| 4,292,966 | 10/1981 | Monö et al. | 222/3 X |
| 4,305,528 | 12/1981 | Craig | 222/182 |
| 4,511,069 | 4/1985 | Kalat | 222/263 |
| 4,513,889 | 3/1985 | Beard | 222/492.1 X |
| 4,576,315 | 3/1986 | Vitale | 222/153 |
| 4,646,946 | 3/1987 | Reyner | 222/386.5 |
| 4,776,499 | 10/1988 | Magid | 222/402.1 X |
| 4,831,013 | 5/1989 | Francis | 514/23 |

FOREIGN PATENT DOCUMENTS

| | | | |
|---|---|---|---|
| 0232104 | 8/1987 | European Pat. Off. | 222/454 |

*Primary Examiner*—Robert P. Olszewski
*Assistant Examiner*—Boris Milef
*Attorney, Agent, or Firm*—Lyon & Lyon

[57] ABSTRACT

Apparatus and method for delivering one or more aliquots of a sterile solution into a sterile receptacle without contamination of the sterile solution, the method including the steps of: a) providing a packaged solution held within a gas-pressurized or pressure-activated container, the container having a valve with a first inner conduit, an actuator which cooperates with the valve to allow opening and closing of the valve, and a delivery conduit having a second inner channel, wherein the valve and actuator are positioned between the container and the delivery conduit, the actuator cooperating with the valve and conduit to connect the first and second inner channels, b) sterilizing the solution, and at least the inside part of the container and a portion of the outside of the container including the valve, the actuator, and the delivery conduit, c) positioning the delivery conduit in relationship to the receptacle to cause liquid from the second inner channel to enter the receptacle when the valve is opened, and d) opening the valve with the actuator, whereby the sterile solution is forced through the first and second inner channels and then enters the sterile receptacle.

19 Claims, 1 Drawing Sheet

STERILE TRANSFER SYSTEM

BACKGROUND OF THE INVENTION

This invention relates to delivery systems suitable for transferring a sterile solution from a container to a receptacle.

Craig, U.S. Pat. No. 4,305,528, describes an aerosol can having a delivery tube which engages the actuator orifice. A cap is provided to cover the actuator orifice and part of the delivery tube. Other aerosol cans having delivery tubes are described by Stephenson et al., U.S. Pat. No. 4,278,188, Eberhardt et al., U.S. Pat. No. 3,428,224, Beres et al., U.S. Pat. No. 3,305,144, and Haber et al., U.S. Pat. No. 4,096,974.

A variety of caps have been described which prevent inadvertent activation of the actuator of an aerosol can. For example, Vitale, U.S. Pat. No. 4,576,315, Jordan, U.S. Pat. No. 2,775,372, Doyle, U.S. Pat. No. 3,565,295, Frankenberg, U.S. Pat. No. 3,225,958, Suellentrop, U.S. Pat. No. 2,947,451, Wassilieff, U.S. Pat. No. 3,690,519, Patton et al., U.S. Pat. No. 3,022,922, and Cochran, U.S. Pat. No. 2,961,128.

Sterile solutions are commonly handled in many types of laboratories. For example, tissue culture fluids and microbiological cell culture solutions are transferred from sterile glass containers to Petri dishes and used to culture either mammalian or bacterial cells. The process of transfer generally entails removing a cap from the glass bottle, removing the lid of the Petri dish, pipetting or pouring the tissue culture fluid from the container to the Petri dish, replacing the lid of the Petri dish and then replacing the lid of the container.

SUMMARY OF THE INVENTION

In a first aspect, the invention features a method for delivering one or more aliquots of a sterile solution into a sterile receptacle without contamination of the sterile solution. The method includes providing a packaged solution held within a gas-pressurized or pressure-activated container, the container has a valve with a first inner channel, an actuator which cooperates with the valve to allow opening and closing of the valve and a delivery conduit having a second inner channel, with the valve and actuator positioned between the container and the delivery conduit, the actuator cooperating with the valve and conduit to connect the first and second inner channels; sterilizing the solution and at least the inside part of the container and a portion of the outside of the container including the valve, the actuator and the delivery conduit; positioning the delivery conduit in relationship to the receptacle to cause liquid from the second inner channel of the delivery conduit to enter the receptacle when the valve is opened; and opening the valve with the actuator, whereby the sterile solution is forced through the first inner channel, the second inner channel and then enters the sterile receptacle.

In preferred embodiments, the two steps of positioning and opening are repeated a plurality of times.

In a second aspect, the invention features a method for manufacture of a gas-pressurized or pressure-activated device including the steps of providing a gas-pressurized or pressure-activated container having a sterile packaged solution, a cap, a valve, an actuator, wherein the actuator cooperates with the valve to allow opening and closing of the valve and a delivery conduit; sterilizing the valve, the actuator and the delivery conduit; covering the sterilized valve and actuator with the cap, wherein the cap is positioned to prevent contamination of the valve and actuator; and covering the delivery conduit to prevent its contamination.

In preferred embodiments of the above aspects, the sterile solution is chosen from a tissue culture medium, a microbiological cell culture solution, and other cell culture related solutions for use with living cells; the sterilizing step includes irradiating the valve, actuator, and conduit; the covering of the delivery conduit step includes covering the conduit with a plastic cover; and the covering of the sterilized valve and actuator step includes hermetically sealing a cap about the valve and actuator.

In a third aspect, the invention features a liquid delivery kit including a gas-pressurized or pressure-activated container containing a sterile liquid, a sterile valve and actuator, wherein the actuator cooperates with the valve to allow opening and closing of the valve, and a cap positioned to maintain the sterility of the valve and actuator. Also provided is a sterile delivery conduit sized and shaped to cooperate with the actuator to connect inner portions of the valve and conduit to allow sterile delivery of the liquid from the container to a desired location, wherein the sterile conduit, valve and actuator together have fewer microorganisms than are necessary to cause contamination of a cell culture medium.

In preferred embodiments, the container is a metal, glass, or plastic aerosol can; the sterile liquid is a tissue culture fluid, a microbiological cell culture solution, or another cell culture related solution for use with living cells; the cap is hermetically sealed about the valve and actuator; the conduit is a 1 to 10 inch plastic or metal tube; and the conduit is sealed with a plastic wrapping to maintain sterility of the conduit. Most preferably, the container is formed of transparent plastic, e.g., polyethylene terphthalate, to allow visual inspection of the liquid; even more preferably the container is graduated.

In a fourth aspect, the invention features a sterile delivery conduit sized and shaped to cooperate with an actuator of a gas pressurized or pressure activated container to allow sterile delivery of a liquid from the container to a desired location. The conduit is held within a wrapper able to maintain the sterility of the conduit, with fewer microorganisms than are necessary to cause contamination of a cell culture medium. Preferably, the wrapper is a plastic, paper or foil cover, and the container is an aerosol can.

In a fifth aspect, the invention features a pressurized graduated container containing sterile liquid e.g., a tissue culture medium, a microbiological cell culture solution, or other cell culture related solutions for use with living cells.

This invention provides delivery systems which reduce the risk of microbial and/or chemical contamination of sterile solutions during transfer operations. The invention also decreases the time spent in transferring such liquids, and reduces the need for use of sterile pipettes for such transfer. Thus, the risk of microbial or chemical contamination of the sterile solution is reduced. The invention also permits the use of an inert gas atmosphere, e.g., nitrogen, around the contained solution to reduce the rate of oxidation or chemical decomposition of the solution. This is especially important for oxygen sensitive cell culture solutions. Further, the invention allows not only sterile delivery of a solution but also ensures that the source of the sterile solution and the transferred solution remain sterile. Small or large amounts of liquid can be readily dispensed into either small or large receptacles as desired.

Generally, the invention features an aerosol bottle or can having a sterile solution with liquid dispensing surfaces maintained in a sterile condition preferably by a hermetically sealed cap. The liquid contents are delivered to a sterile receptacle by means of a sterile plastic disposable delivery tube which is attached to the aerosol dispensing orifice at the time of use. The delivery tube can be sterile packaged individually to facilitate sterile attachment of the tube to the dispensing orifice of the aerosol can. The propellent, such as nitrogen, in the aerosol can is chosen to be chemically compatible with the stored solution.

Preferably, polyethylene terphthalate (PET) and other transparent plastic materials suitable for fabricating pressurized containers are used to allow visual inspection of the contents of the aerosol canisters of the present invention. Canister transparency is useful since it allows verification that no turbidity exists in the contained solution immediately prior to dispensing. Turbidity is an indication of either chemical precipitation or bacterial contamination, neither of which is desirable. Container transparency also allows the user to determine the amount of solution remaining inside the aerosol canister. Since it is often important to also measure the approximate volume of cell culture solutions being dispensed from such a canister, volumetric graduation markings are placed on the outside surface of the aerosol canister of the present invention. For example 5 and 10 ml graduation markings are printed on 200–500 ml capacity canisters, and 1 and 5 ml graduations are placed on 50–100 ml capacity canisters.

By including volumetric markings on an essentially cylindrical transparent aerosol container, the present invention shares a degree of similarity with the graduated cylinder. However, certain advantages are achieved over the graduated cylinder. For example, in attempting to dispense given volumes of liquid from a conventional graduated cylinder, the user must carefully tilt, pour and check the liquid meniscus position several times before arriving at the correct dispensed volume. However, with the present invention, the volumetric canister remains upright during dispensing and therefore the amount of liquid dispensed may be read easily and continuously. This feature allows more rapid volumetric dispensing and results in fewer incidents of liquid "overshoot" (dispensing more liquid than desired). Therefore, the present invention acquires certain advantages over the qraduated cylinder since it can be used in an upright position and under pressure.

Other features and advantages of the invention will be apparent from the following description of the preferred embodiments, and from the claims.

DESCRIPTION OF THE PREFERRED EMBODIMENTS

Figures 1, 1A, 2A, 2B:
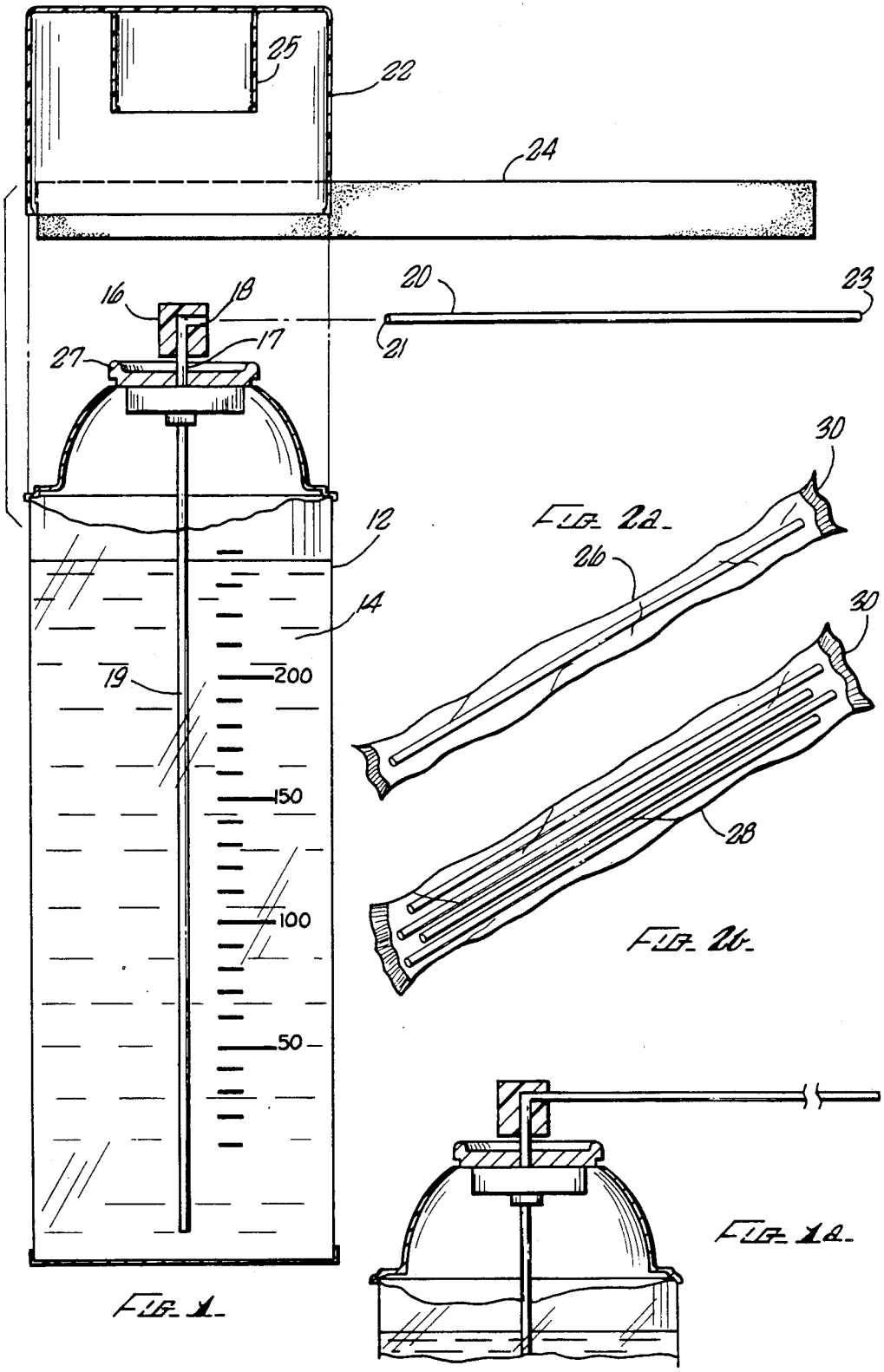

The drawings will first briefly be described.

Drawings

FIGS. 1*a* and 1*b* are an exploded isometric partly sectional view of an aerosol can;

FIG. 1A is an isometric partially sectional view of the top of the aerosol can in FIG. 1, showing connection of a delivery tube; and FIGS. 2*a* and 2*b* are isometric views of sterile disposable delivery tubes suitable for attachment to the actuator of an aerosol can.

Structure

Referring to FIG. 1, aerosol can 12 enclosing sterile tissue culture medium 14 includes an actuator 16 which controls delivery of sterile liquid 14 through a valve 17, and an aperture 18 through which the sterile liquid must pass. An elongated dip tube 19 is provided to connect aperture 18 with sterile liquid 14. Also provided is a sterile delivery tube 20 having one end 21 shaped to fit within aperture 18 to allow delivery of sterile liquid 14 through delivery tube 20 to its other end 23. Referring to FIG. 1*a*, actuator 16 acts to connect an inner channel 32 of valve 17 with an inner channel 34 of a delivery tube 20. Inner channel 32 of valve 17 and inner channel 36 of dip tube 19 are connected by standard means 38. Pressure on actuator 16, shown by arrow 40, opens valve 17 and gas pressure within can 12 forces liquid 14 through valve 17 and through delivery tube 20. A cap 22, having sterile inner surfaces, is sized to fit over actuator 18 and the top of aerosol can 12. Cap 22 includes a circular projection 25 sized to sealing fit around a corresponding circular ridge 27 of the valve cup 29 formed around actuator 16 and a valve 17 on the aerosol can. Cap 22 is hermetically sealed to aerosol can 12 using sealing tape or other sealing wrapper 24 to maintain sterility of the actuator.

Aerosol can 12 is formed of transparent polyethylene terphthalate and is provided with graduations 42 representing liquid volume, in milliliters, in can 12.

Referring to FIGS. 2*a* and 2*b*, delivery tube 20 is fabricated from polyethylene, polypropylene, or other thermoplastic tube of length 1–10 inches, preferably 2–6 inches, and packaged and sterilized either individually in a package 26 (FIG. 2*a*), or as a group of tubes 28 (FIG. 2*b*). Individual or group-packaged tubes are covered by a gamma radiation resistant polyethylene wrapper 30. Wrapper 30 is easily removed from around tube 20.

Aerosol can 12 and tube 20 are manufactured by standard technique. Similarly sterile delivery tube 20 is packaged by standard technique within wrapper 30.

EXAMPLE 1

Standard Dulbecco s phosphate-buffered saline solution (PBS) was prepared and packaged in a commercial 12 oz. aerosol can with nitrogen gas propellent. The can was capped with a polyethylene cap and hermetically-sealed with polyethylene tape. The whole assembly was sterilized by exposure to 5 megarads gamma radiation. Polyethylene and polypropylene plastic disposable delivery tubes (4 inches in length) were packaged in 2 mil. thick polyethylene film wrappers and likewise sterilized by gamma radiation. Sterile transfer of the PBS solution from the aerosol cans (via the delivery tube attached to the actuator of the aerosol can) into sterile cell culture flasks was confirmed by sterility testing of the PBS solution delivered to the cell culture flask.

EXAMPLE 2

Fetal bovine serum (FBS) for cell culture was aerosol-packaged with nitrogen gas propellent, gamma radiation sterilized, and delivered as described for PBS in Example 1. The FBS sterility and biological activity was tested in tissue culture. Growth rates indistinguishable from those obtained with conventionally packaged FBS were observed.

Use

Aerosol can 12 is provided in a sterile condition with cap 22 hermetically sealed by tape 24 to canister 12. Prior to use, tape 24 and cap 22 are removed and end 21 of a sterile delivery tube 20 (partially removed from wrapper 30) is inserted into orifice 18. Wrapper 30 is then completely removed from delivery tube 20. Preferably this procedure is performed in a laminar flow cell culture hood. The exposed end 23 of the delivery tube is placed within a Petri dish by slightly lifting the lid of the Petri dish. Liquid from the aerosol can is delivered to the Petri dish by opening valve 17 by pressing upon actuator 16. After use, delivery tube 20 is discarded and cap 22 and tape 24 replaced to maintain actuator 16 and aperture 18 in a sterile condition. Tape 24 e.g., adherent polyethylene tape (Minnesota Mining and Manufacturing) is chosen to prevent microorganisms, viruses and the like from contacting aperture 18 and contaminating sterile liquid 14 either within aerosol can 12, or when sterile liquid 14 is forced from canister 12.

Other Embodiments

Other embodiments are within the following claims. For example, pressure on liquid 14 may be provided by pressurized gas as described above, or by manual pressure means to mechanically reduce the internal volume of container 12.

I claim:

1. A method for delivering one or more aliquots of a sterile solution into a sterile receptacle without contamination of said sterile solution, said method comprising the steps of:

a) providing a packaged solution held within a gas-pressurized or pressure-activated container, said container having a valve with a first inner channel, an actuator, wherein said actuator cooperates with said valve to allow opening and closing of said valve, and a separate elongated delivery conduit having a second inner channel, wherein said valve and actuator are positioned between said container and said delivery conduit, the actuator cooperating with the valve and conduit to connect said first and second inner channels, b) sterilizing said solution, the inside part of the container and a portion of the outside of the container including said valve, said actuator, and said delivery conduit, c) positioning said delivery conduit in relationship to said receptacle to cause liquid from said second inner channel to enter said receptacle when said valve is opened, and d) opening said valve with said actuator, whereby said sterile solution is forced through said first and second inner channels and then enters said sterile receptacle.

2. The method of claim 1, further comprising repeating steps c) and d) a plurality of times.

3. A method for manufacture of a gas pressurized or pressure activated device, comprising the steps of:

providing a gas-pressurized or pressure-activated container comprising a packaged solution, a cap, a valve, an actuator, wherein said actuator cooperates with said valve to allow opening and closing of said valve, b) sterilizing said solution, valve, actuator and delivery conduit, c) covering said sterilized valve and actuator with said cap wherein said cap is positioned to prevent contamination of said valve and said actuator, and d) covering said delivery conduit to prevent contamination of said delivery conduit.

4. The method of claim 1, or 3 wherein said sterile solution is selected from a group consisting of a tissue culture medium, a microbiological cell culture solution, and other cell culture related solutions for use with living cells.

5. The method of claim 1, or 3 wherein said sterilizing step comprises irradiating said valve, actuator or conduit.

6. The method of claim 3 wherein said covering said delivery conduit step comprises covering said conduit with a plastic, paper or foil cover.

7. The method of claim 3 wherein said covering said sterilized valve and actuator step comprises hermetically sealing a cap about said valve and actuator.

8. The method of claim 1, 2 or 3 wherein said container is formed of transparent material.

9. The method of claim 8 wherein said container is qraduated.

10. A liquid delivery kit comprising:

a gas-pressurized or pressure-activated container comprising a sterile liquid, a sterile valve, and actuator and a cap positioned to maintain the sterility of said valve and actuator, wherein said actuator cooperates with said valve to allow opening and closing of said valve, and a separate elongated sterile delivery conduit sized and shaped to cooperate with said actuator to connect inner portions of said valve and conduit to allow sterile delivery of said liquid from said container to a desired location, wherein said sterile conduit, valve, and actuator together comprise fewer microorganisms than are necessary to cause contamination of a cell culture medium.

11. The kit of claim 10, said container being a metal, glass or plastic aerosol can.

12. The kit of claim 10, said container being transparent.

13. The kit of claim 10, said container being formed from polyethylene terphthalate.

14. The kit of claim 13, said container being graduated.

15. The kit of claim 11 said sterile liquid being chosen from tissue culture medium, a microbiological cell culture solution, and other cell culture related solutions for use with living cells.

16. The kit of claim 11 wherein said cap is hermetically sealed about said valve and actuator.

17. The kit of claim 11 said conduit being a 1–10 inch plastic, paper or foil or metal tube.

18. The kit of claim 11 said conduit being sealed by a plastic wrapper to maintain sterility of said conduit.

19. A pressurized graduated container comprising a sterile liquid said liquid being chosen from a tissue culture solution, a microbiological cell culture solution and other cell culture related solutions for use with living cells.

* * * * *